US008021218B2

(12) United States Patent
Osvatic et al.

(10) Patent No.: US 8,021,218 B2
(45) Date of Patent: Sep. 20, 2011

(54) LINEAR TRAVEL AIR DAMPER

(75) Inventors: Michael Osvatic, Waukesha, WI (US); Joel C. Bragg, Waterford, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 1181 days.

(21) Appl. No.: 11/065,947

(22) Filed: Feb. 25, 2005

(65) Prior Publication Data

US 2005/0189184 A1 Sep. 1, 2005

Related U.S. Application Data

(60) Provisional application No. 60/547,920, filed on Feb. 26, 2004.

(51) Int. Cl.
*F25D 17/08* (2006.01)

(52) U.S. Cl. ..... 454/333

(58) Field of Classification Search ..... 454/274, 454/339, 333, 334

See application file for complete search history.

(56) References Cited

U.S. PATENT DOCUMENTS

| | | | | |
|---|---|---|---|---|
| 3,589,268 | A * | 6/1971 | Steiner | 454/350 |
| 4,584,511 | A * | 4/1986 | Rudich et al. | 318/600 |
| 4,644,239 | A | 2/1987 | Yoshikawa et al. | |
| 4,800,804 | A * | 1/1989 | Symington | 454/257 |
| 4,852,361 | A * | 8/1989 | Oike | 62/131 |
| 5,375,413 | A * | 12/1994 | Fredell et al. | 62/187 |
| 5,876,014 | A | 3/1999 | Noritake et al. | |
| 5,944,506 | A * | 8/1999 | Kamal et al. | 431/159 |
| 6,058,726 | A | 5/2000 | Noritake | |
| 6,069,466 | A | 5/2000 | Noritake et al. | |
| 6,244,564 | B1 | 6/2001 | Noritake | |
| 6,301,910 | B1 | 10/2001 | Noritake et al. | |
| 6,325,012 | B1 * | 12/2001 | Aristizabal | 114/314 |
| 6,330,891 | B1 | 12/2001 | Noritake | |
| 6,512,435 | B2 | 1/2003 | van Namen | |
| 2001/0055947 | A1 * | 12/2001 | McCabe | 454/369 |
| 2003/0122517 | A1 * | 7/2003 | Lange et al. | 318/471 |

* cited by examiner

*Primary Examiner* — Steven B McAllister
*Assistant Examiner* — Samantha A Miller
(74) *Attorney, Agent, or Firm* — Boyle Fredrickson, S.C.

(57) ABSTRACT

A damper suitable for use in a refrigerator provides for linear motion of a damper plate toward and away from a damper seat. The damper plate may be driven by an axial lead screw attached to a small DC motor and may employ a non-foam gasket to reduce water absorption and possible formation of obstructing ice.

10 Claims, 2 Drawing Sheets

LINEAR TRAVEL AIR DAMPER

CROSS-REFERENCE TO RELATED APPLICATIONS

This application claims the benefit of U.S. Provisional application 60/547,920 filed Feb. 26, 2004 hereby incorporated by reference.

STATEMENT REGARDING FEDERALLY SPONSORED RESEARCH OR DEVELOPMENT

--

BACKGROUND OF THE INVENTION

The present invention relates to an air damper for control of the flow air, for example, between compartments of a refrigerator, and in particular to an improved air damper with linear valve travel and a low cost electric actuator.

A household refrigerator may provide for a number of different compartments with different temperature and humidity conditions. A convenient method of creating these multiple environments employs one or more dampers controlling the flow of air flow between the compartments.

Dampers of this type may use a pivoting door or flapper that is opened and closed by a motor or other actuator. The actuators are normally limited to relatively low wattage devices, for example, low voltage DC motors, to reduce cost, promote energy efficiency, and to minimize heat dissipation by the actuator within the refrigerator.

The operating environment of the dampers, positioned between chambers with different air temperatures and humidities, can produce condensation and icing on the damper components. Ice can interfere with the pivoting action of the flapper by encrusting the pivot point of the flapper or by causing adhesion between the outboard portion of the flapper and the rim of the damper opening where small amounts or resistance can require large torques to overcome.

In order to eliminate leakage around the flapper, the flapper may include a gasket compressed between the flapper and the damper opening. This gasket is often a highly compliant foam material sealing with low compression forces. The foam gasket accommodates the varying forces, and possibly varying separation, between the flapper and damper opening caused by the pivoting action of the flapper.

A drawback to foam gaskets is that they may absorb water, freeze, and become less compliant or adhered to the damper opening, as described above. Further, foam gaskets may become brittle with time losing their compliance and sealing ability.

BRIEF SUMMARY OF THE INVENTION

The present invention provides a damper having a damper plate that moves linearly rather than with a pivoting motion to cover or uncover the opening of a damper seat. The linear motion may be provided by a lead screw driven by a small DC motor. The linear motion and the mechanism that produces it are more resistant to the effect of icing and permits the use of improved gasketing material. The lead screw mechanism may incorporate springs to prevent jamming of the damper plate against stops when the device is operated with open loop control as is typical in appliances.

Specifically, the present invention provides an electrically actuated damper providing a motor with an axial lead screw. A damper plate has an attached threaded portion engaging the lead screw. A housing provides an air passageway through a damper seat and supports the damper plate for movement with the lead screw to cover and uncover the damper seat when the lead screw is rotated in a first and second direction, respectively.

Thus, it is one object of at least one embodiment of the invention to provide a simple mechanism for producing linear motion in a damper plate and one which may provide relatively high opening and closing forces that are not diminished by the lever action found in a typical flapper design.

The motor may be a permanent magnet DC brush motor having an operating voltage of less than 12 volts.

Thus, it is another object of at least one embodiment of the invention to provide a simple damper mechanism that works well with low wattage electric motors. The lead screw provides mechanical advantage necessary to open the damper against limited icing without the need for complex gear trains or the like.

The damper may include a gasket formed from a material without air cells as part of the damper plate and/or damper seat.

Thus, it is another object of at least one embodiment of the invention to provide a damper that provides more uniform closure of the damper plate against the damper seat avoiding the necessity of using a highly compliant foam gasket.

The gasket may be an elastomeric material cantilevered in radial extension at the periphery of the damper plate.

Thus, it is another object of at least one embodiment of the invention to provide sealing with elastomeric material that is flexible but relatively resistant to compression.

The axial lead screw may have external threads and the threaded portion of the damper plate may be a collar attached to the damper plate with internal threads fitting about the axial lead screw.

Thus, it is another object of at least one embodiment of the invention to provide a mechanism that is more resistant to icing than gears. The advancing collar may clean off a light coating of ice from the lead screw.

The collar may include key surfaces fitting within a keyway preventing rotation of the damper plate. The keyway may be of substantially smaller radial extent than the damper plate.

Thus, it is another object of at least one embodiment of the invention to prevent rotation of the threaded portion of the damper plate using a small area keyway offering limited area for icing.

The keyway may be open at two axial ends so that movement of the collar through the keyway may eject accumulated ice.

Thus, it is another object of at least one embodiment of the invention to prevent ice from being compacted within the keyway.

The collar may be positioned at least partially within the keyway at extreme positions of the collar.

It is therefore another object of at least one embodiment of the invention to prevent the formation of ice obstructions that must be dislodged by shearing the ice.

The housing and damper plate may be thermoplastic material.

Thus, it is another object of at least one embodiment of the invention to provide an inexpensive means of fabricating parts from a material that is resistant to moisture and that has some natural lubricity.

The lead screw may be stainless steel.

It is thus another object of at least one embodiment of the invention to provide a high tolerance, low friction lead screw material resistant to ice adhesion.

The damper may include a stop for limiting motion of the damper plate in uncovering the damper seat and further including at least one spring biasing the damper plate away from the stop.

It is thus another object of at least one embodiment of the invention to prevent momentum of the damper plate toward the stop from jamming the damper plate when driven by a motor operated to stall. By dissipating energy into the spring, the damper may be operated without limit switches or the like reducing the cost of the system.

The spring may be a helical compression spring fitting coaxially about the axial drive shaft between the stop and the damper plate.

Thus, it is another object of at least one embodiment of the invention to provide a simple method for supporting a spring that requires no additional structure.

The motor may include a series, current-limiting resistor allowing the motor to operate in stall condition without damage.

It is thus another object of at least one embodiment of the invention to provide the ability to use small DC brush motors in an open loop configuration without damage to the motor.

These particular objects and advantages may apply to only some embodiments falling within the claims and thus do not define the scope of the invention.

DETAILED DESCRIPTION OF THE PREFERRED EMBODIMENT

Figure 1:
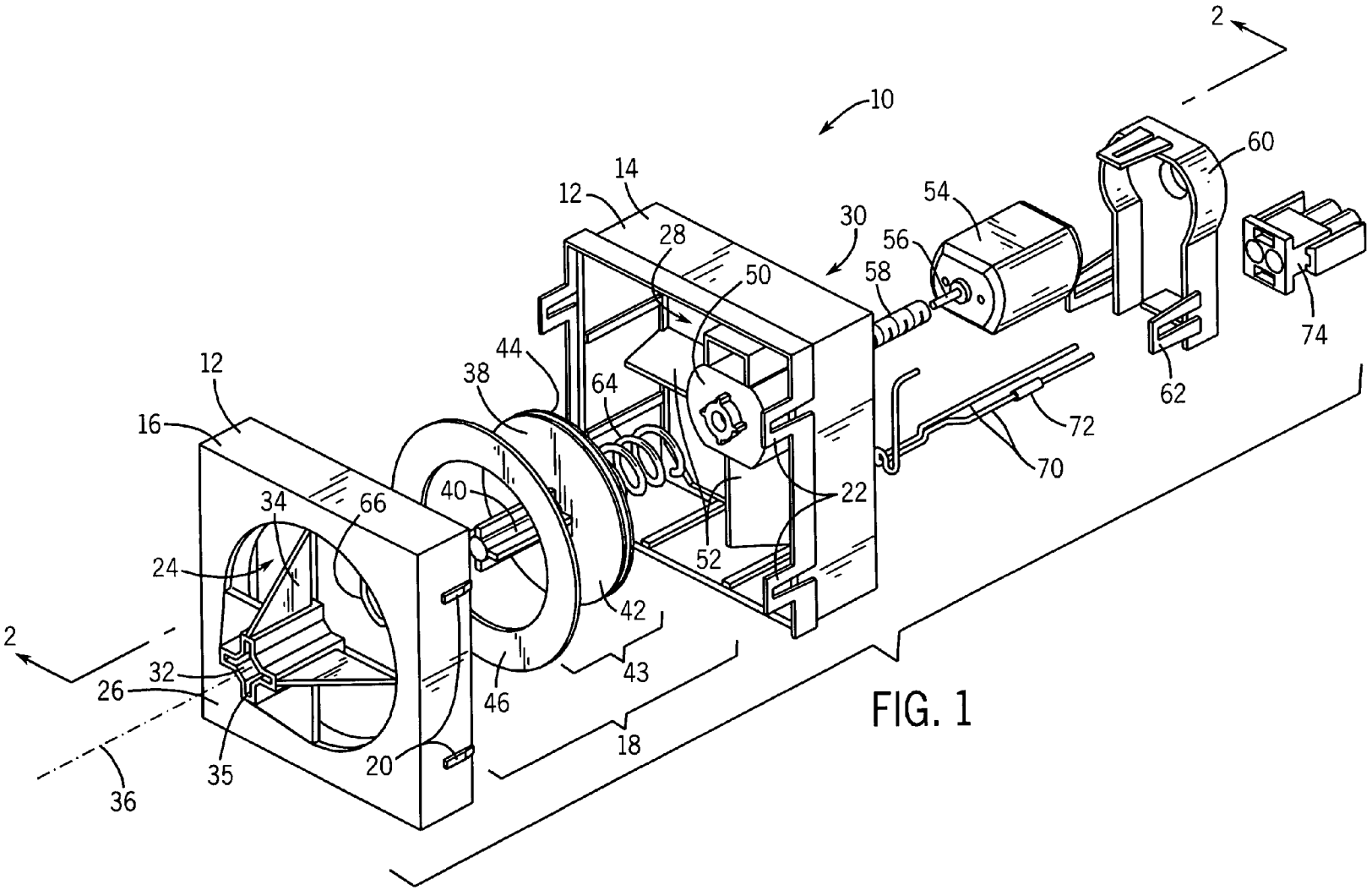
FIG. 1 is a perspective, exploded view of the damper of the present invention showing a motor for turning an axial lead screw to move a damper plate against a damper seat formed in a housing.
Figure 2:
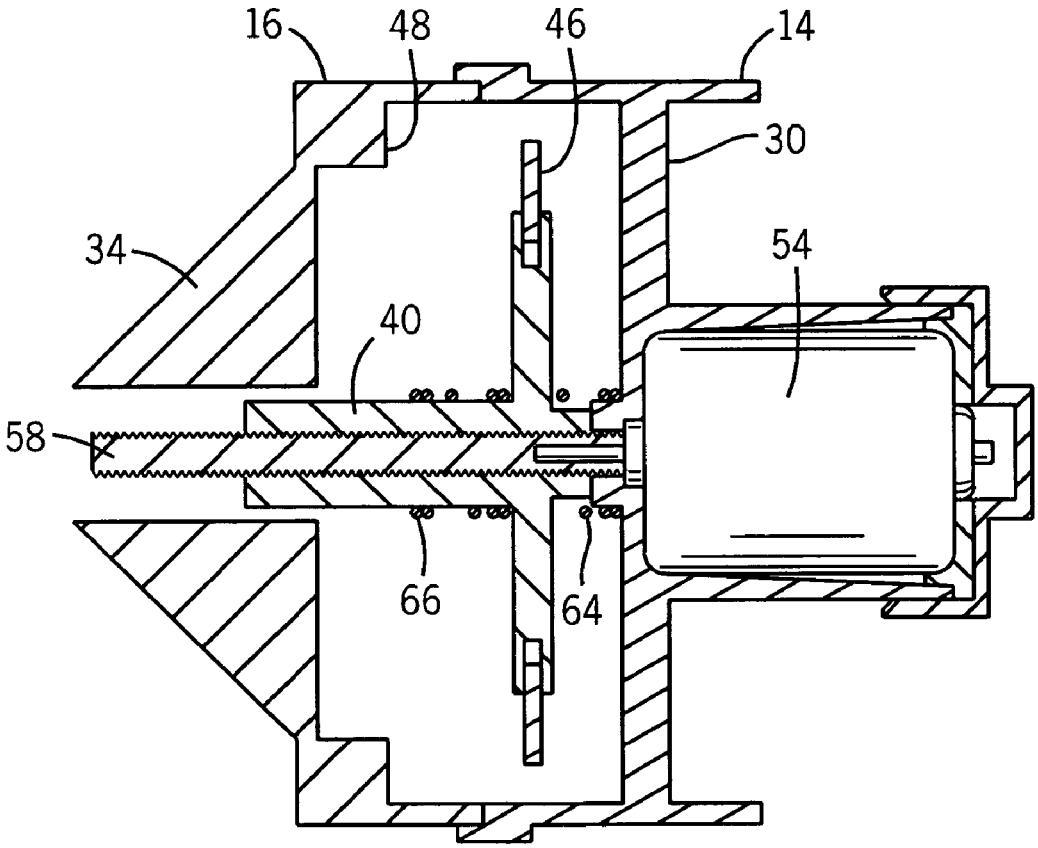
FIG. 2 is a cross-section along lines 2-2 of FIG. 1 showing springs for use in preventing jamming of the damper plate when driven to either extreme within the housing.

Referring now to FIGS. 1 and 2, the damper 10 of the present invention may provide a generally rectangular housing 12 having a rear housing portion 14 and a front housing portion 16 fitting together to enclose a volume 18 through which air may flow in a generally axial direction 36. The front housing portion 16 and rear housing portion 14 are held together by means of laterally extending teeth 20 on the sides of the front housing portion 16 that are engaged by corresponding axially extending hasps 22 on the sides of rear housing portion 14 or by welding or other similar method.

In use, the housing 12 blocks an opening between two compartments between which airflow must be controlled, for example, in a refrigerator. Front housing portion 16 provides a generally circular air passage 24 on its front rectangular face 26 whereas rear housing portion 14 includes a generally rectangular air passage 28 on its rear rectangular face 30. In the preferred embodiment, each air passage 24 may be approximately 3 square inches in area.

Supported coaxially within air passage 24 is a front bearing 32 held by a spider support 34. The spider support 34 extends radially outward from the bearing 32 to attach at four points to the inner edge of the air passage 24. The spider support 34 thus allows the passage of air around the outside of bearing 32 through the air passage 24.

Bearing 32 includes an axially extending keyway 35 which, in the preferred embodiment, has a cruciate cross-section.

A circular valve disk 38 held within the volume 18 includes an axially extending key 40 having an outer cross section corresponding to the inner cross section of the keyway 35 so that the key 40 may move freely in an axial direction 36 but be restrained against rotation. The axially extending keyway 35 has a total cross sectional area that is small relative to the area of the circular valve disk 38 so that ice formed in the axially extending keyway 35 has reduced surface to which to adhere and may be more readily dislodged.

The circular valve disk 38 lies in a plane perpendicular to the axial direction 36 and has an outer periphery including a radially extending and opening groove 44 that may receive an inner lip of an annular elastomeric washer 46. The groove 44 thus holds the annular elastomeric washer 46 extending radially outward from the edge of the valve disk 38 in cantilevered fashion.

Together the elastomeric washer 46 and the valve disk 38 comprise a damper plate 43 that may move axially to block air flow through the air passage 24 when the elastomeric washer 46 abuts a circular shoulder extending into the volume 18 and surrounding air passage 24 to form a damper seat 48. When the damper plate 43 is displaced backward from damper seat 48, air may flow freely around the damper plate 43 through the volume 18.

Attached concentrically within air passage 28 of rear housing portion 14 is a motor support 50. The motor support is held centered within the air passage 28 on a spider support 52 (similar to spider support 34) supporting the motor support 50 and allowing air flow through air passage 28 and around the motor support 50.

Motor support 50 provides a shell into which a low-voltage, brush, DC permanent magnet motor 54 may fit with an axle 56 of the motor 54 extending forward along axial direction 36 into the volume 18. Motor 54 may, for example, have an operating voltage of less than 12 volts and in the preferred embodiment an operating voltage of 1.5 volts and, a power consumption limited to less than a few watts.

An axial threaded shaft 58 is press-fit to the axle 56 to be rotatable by the motor 54 and to extend through the volume 18. The threaded shaft 58 is received by corresponding internal threads of the key 40 surrounding the threaded shaft like a collar. The threaded shaft 58 is of a length sufficient to extend into the keyway 35 after passing through the key 40. Desirably, the key is always at least partially within the keyway to prevent the formation of capping ice that would block entry of the key 40 into the keyway 35.

In an alternative embodiment, the threads of the threaded shaft 58 may be received by an internally threaded ball joint that fits within the valve disk 38 and swivels to allow slight amounts of axial misalignment between valve disk 38 and the elastomeric washer 46 and damper seat 48.

Optionally, the exposed portion of the threaded shaft 58 may be covered by a rubber bellows (not shown) to provide resistance to ice build up.

The motor 54 is held against axial movement within the motor support 50 by an end cap 60 which has hasps 62 engaging corresponding teeth (not shown) on the motor support 50 to retain the motor 54. The outer circumference of the motor 54 is non-cylindrical and the motor support 50 conforms to that non-cylindrical shape to prevent rotation of the motor 54 within the motor support 50.

Helical compression springs 64 and 66 fit coaxially around the threaded shaft 58 on either side of the valve disk 38 (with helical compression spring 66 fitting over the key 40) so as to provide axial forces away from either rear housing portion 14 or front housing portion 16 as the valve disk 38 closely approaches the rear housing portion 14 or front housing portion 16, respectively. The purpose of these helical springs is to prevent torque "lock" caused by an abrupt stopping of motion of the damper plate 43 as will be described below.

Wires 70 may be attached to the motor 54 and include a series resistor 72 limiting motor stall current as will be described below. The series resistor 72 allows a voltage to be applied to the damper 10 in excess of the operating voltage of the motor 54.

The wires 70 pass out of the motor support 50 and end cap 60 to be received by a standard electrical connector 74 allowing simple attachment and removal of the electrical connections to the damper 10.

In use, the damper 10 may be operated to cause the motor 54 to move the damper plate 43 between an opened and closed state. As will be understood to those of ordinary skill in the art, electrical energy is required only during this period of movement and not during the time the damper 10 remains opened or closed after movement is complete.

During operation to open the damper 10, a control circuit (not shown) provides a reverse polarity electrical voltage to the motor 54 for a time period slightly longer than the time required for the motor 54 to fully retract the damper plate 43 from a closed state to an open position. At the open position, the damper plate 43 will be adjacent against a stop surface of the rear housing portion 14 compressing the compression spring 64 between the damper plate 43 and that stop surface.

The length of the compression spring 64 is such as to engage (or alternatively to apply significant force to) both the damper plate 43 and a surface of the rear housing portion 14 only at the end of the travel of the damper plate 43. As the damper plate 43 continues to open, the compression spring 64 slows the motor 54 reducing the rotational momentum of the motor 54 and threaded shaft 58 to below a predetermined amount before the damper plate 43 stops. This prevents the momentum from being converted into additional torque that might produce a frictional locking of the threads of the threaded shaft 58 and internal threads of the keyway 35 that cannot be overcome by later reversing the motor 54.

After that damper 10 is open, air may flow through the front housing portion 16 and out the rear housing portion 14 until a desired temperature relationship exists between two zones connected by the damper 10. The desired temperature may be detected by a thermocouple or the like communicating with the control circuit driving the motor 54.

When the desired temperature range is reached, the control circuit may provide a positive polarity electrical voltage to the motor 54 for a time period slightly longer than the time required for the motor 54 to fully extend the damper plate 43 from the open state to the closed position abutting damper seat 48. At this time, the compression spring 66 is compressed between a front portion of the valve disk 38 and a rear portion of the front housing portion 16. Per the operation of the helical compression spring 64, helical compression spring 66 resists the last increment of forward travel of the damper plate 43 slowing the motor 54 and threaded shaft 58 to prevent inertial locking of the threads of the threaded shaft 58 and internal threads of the keyway 35.

In an alternative embodiment, the slowing of the motor may be accomplished by flexure of the gasket or by inducted friction from a mechanism not subject to torque lock, for example, a friction pad applied to the axial threaded shaft 58.

At this point, the elastomeric washer 46 abuts the damper seat 48 and may flex inward slightly to bleed off additional rotational energy of the motor 54 and threaded shaft 58. The damper plate 43 now closes air passage 24 preventing airflow through the housing 12.

In both opening and closing the damper 10, the pulse of voltage provided to the motor 54 by the control circuit is longer than that required for full travel of the damper plate 43 thus ensuring complete opening and complete closing of the damper plate 43 without the need for feedback to the control circuit as might be otherwise provided by limit switches or other well known means. This open loop control of the motor 54 results in a stalling of the motor 54 when the damper plate 43 has reached the full extent of its travel in either direction. Additional current draw by the motor 54 at these times (until expiration of the current pulse) is limited by resistor 72 to prevent unacceptable heating of the motor 54 in a stall condition. A large proportion of voltage drop across the resistor 72 provides an essentially constant current to the motor 54 even during stall. The size of resistor 72 and the length of the stall period may be varied for particular applications and temperature ranges as will be understood by those with ordinary skill in the art.

Direct drive of the valve disk 38 by a threaded shaft attached to motor 54 eliminates the need for a gear train or the like such as may be more expensive and subject to blockage by ice and the like. Unlike gear teeth, the threads of the threaded shaft 58 and internal threads on key 40 may be made self-cleaning. Ice within the keyway 35 is minimized by extending the threaded shaft 58 into the keyway 35.

In flapper-style dampers, adhesion between the flapper and damper opening away from the pivot point is made worse by the backward acting lever of the pivoting flapper. In the present design, an even speed and force of separation (and closure) is applied over the entire contacting region of the door and seat. The present design may also provide a quieter operation as there is no abrupt slapping of a door rapidly driven by a motor or solenoid.

The elastomeric washer 46 may be constructed of a solid elastomeric material as opposed to a foam material, thus minimizing moisture retention and freezing problems. Foam gaskets, incorporating compressible open or closed air cells, are often required for high compliance gaskets needed in flapper type valves, where the different ends of the pivoting flapper experience different rates of closure and hence different compressions under a constant pivot torque and possibly different amounts of separation when closed as a result of manufacturing tolerances and variations in the balance between closure torque and gasket compression force. The air cells of these foam gaskets can hold moisture and often age poorly becoming brittle or fragile over time.

Suitable compliance of the material of the elastomeric washer 46, necessary to ensure an airtight sealing, is obtained from the cantilevered flexure of the elastomeric washer 46 rather than its compression as might require a foam material. Further, the even closing provided by the linear mechanism of the present invention requires far less gasket compliance than is required by flapper type designs.

In an alternative embodiment, graduated opening of the damper 10 may be provided by replacing the motor 54 with a stepper motor of a type well known in the art. The position of the stepper motor and damper plate 43 may be determined by turning the stepper motor in one direction for an amount guaranteed to fully move the damper plate 43 across its full range of travel. Then a predetermined number of steps of the motor may be taken to move the damper plate 43 to a predetermined location between fully open and fully closed. The housing 12 inner surface may be tapered to promote a graduated control of air as a function of position of the valve disk 38 within the volume 18.

The threaded shaft 58 may be constructed of stainless steel material to resist corrosion in a moist and cold environment.

The front housing portion 16, rear housing portion 14, and the valve disk 38 may be constructed of a self-lubricating plastic as may be readily injection molded.

It will be recognized that the threaded shaft 58 may be used not only with disk-shaped valves or valves that translate linearly, but will accommodate other similar designs as would be understood by one of ordinary skill in the art.

Application of the damper 10 may control refrigerator temperatures in different compartments of a refrigerator as well as other areas of airflow control including those associated with heating or the distribution of air in automobiles.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A refrigerator damper comprising:

a housing providing an air passageway along an axis through a damper seat;

a damper plate mounted for movement along the axis with respect to the housing between a closed position covering the damper seat and an opened position uncovering the damper seat by separating the damper plate from the damper seat;

an electric actuator communicating with the damper plate to move the damper plate so that the damper plate moves without pivoting in a straight line between the open and closed positions as constrained in motion by at least one of the electric actuator and the housing, the electric actuator including a motor having a series current limiting resistance allowing the motor to operate in stall condition without damage, wherein the motor drives the damper plate for a time period longer than required for full travel of the damper plate between the closed and open positions;

whereby velocity of closure between the damper plate and the damper seat at all points of contact around the damper plate and damper seat are substantially equal and wherein at least one of the damper plate and damper seat includes a gasket that extends between the damper plate and damper seat when the damper plate is in a closed position; wherein the electric actuator is a motor and a lead screw communicating with a threaded portion of the damper plate to linearly displace the damper plate with rotation of the lead screw; and wherein the damper plate includes key surfaces fitting within a keyway and preventing rotation of the damper plate.

2. The refrigerator damper of claim 1 wherein the gasket is an elastomeric material supported in radial cantilever at a periphery of the damper plate.

3. The refrigerator damper of claim 1 wherein the motor is a permanent magnet DC brush motor having an operating voltage of less than 12 volts.

4. The refrigerator damper of claim 1 wherein the axial lead screw has external threads and the threaded portion is a collar about a bore passing through the damper plate with internal threads fitting about the axial lead screw.

5. The refrigerator damper of claim 1 wherein the keyway is open at two axial ends so that movement of the collar through the keyway may eject accumulated ice.

6. The refrigerator damper of claim 5 wherein the collar is positioned at least partially within the keyway at extreme positions of the collar with rotation of the axial lead screw in the first and second directions.

7. The refrigerator damper of claim 1 wherein the housing and damper plate are thermoplastic.

8. The refrigerator damper of claim 1 wherein the lead screw is stainless steel.

9. The refrigerator damper of claim 1 further including a stop for limiting motion of the damper plate in uncovering the damper seat and further including at least one spring biasing the damper plate away from the stop;

whereby momentum of the damper plate toward the stop is dissipated into the spring preventing a jamming of the threaded portion of the damper plate and the axial lead screw during open loop control of the damper.

10. The refrigerator damper of claim 9 wherein the spring is a helical compression spring fitting coaxially about the axial drive shaft between the stop and the damper plate.

* * * * *

UNITED STATES PATENT AND TRADEMARK OFFICE

CERTIFICATE OF CORRECTION

PATENT NO. : 8,021,218 B2
APPLICATION NO. : 11/065947
DATED : September 20, 2011
INVENTOR(S) : Michael Osvatic et al.

It is certified that error appears in the above-identified patent and that said Letters Patent is hereby corrected as shown below:

CLAIM 5, column 8, line 21, delete "keyway may eject accumulated ice" and substitute therefore -- keyway will eject any accumulated ice in the keyway from the keyway --;

CLAIM 9, column 8, line 32, delete "seat and" and substitute therefore -- seat by the abutment of the stop and a surface moving with the damper plate and --.

Signed and Sealed this
Fourth Day of September, 2012

David J. Kappos

David J. Kappos
*Director of the United States Patent and Trademark Office*